United States Patent [19]

Staples

[11] Patent Number: 4,651,377

[45] Date of Patent: Mar. 24, 1987

[54] BRUSH ATTACHMENT FOR AUTOMATED POOL SWEEPERS

[76] Inventor: Samuel C. Staples, 1909 Oxmoor Rd., Birmingham, Ala. 35209

[21] Appl. No.: 812,452

[22] Filed: Dec. 23, 1985

[51] Int. Cl.[4] ..... E04H 3/20

[52] U.S. Cl. ..... 15/1.7; 134/167 R

[58] Field of Search ..... 15/1.7; 134/167 R, 167 C, 134/168 R, 168 C

[56] References Cited

U.S. PATENT DOCUMENTS 3,170,180 2/1965 Winston et al. ..... 15/1.7

4,356,582 11/1982 Stephenson ..... 15/1.7

*Primary Examiner*—Edward L. Roberts

*Attorney, Agent, or Firm*—Jennings, Carter, Thompson & Veal

[57] ABSTRACT

An attachment for use with automated pool sweeper systems attaches coaxially to the sweep hoses of such system and is carried thereby over the walls and floor of a pool to brush and buff these surfaces. The attachment is a tubular member of a porous foam-like material that is resistant to deterioration in chlorinated water and is resistant to shedding due to wear. The attachment may be snugly secured between wear rings on the hose and may be further secured by an elastomeric member encircling the attachment and the hose.

13 Claims, 4 Drawing Figures

FIG. 1
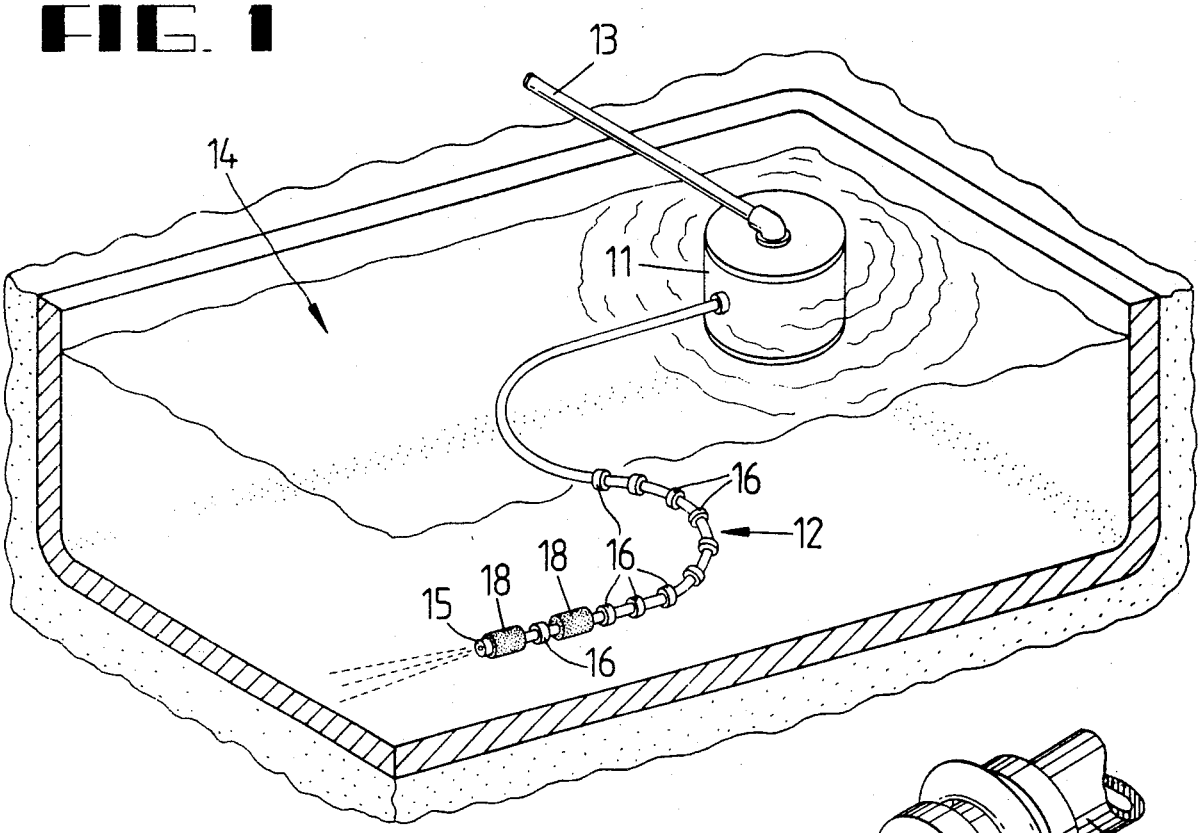
FIG. 2
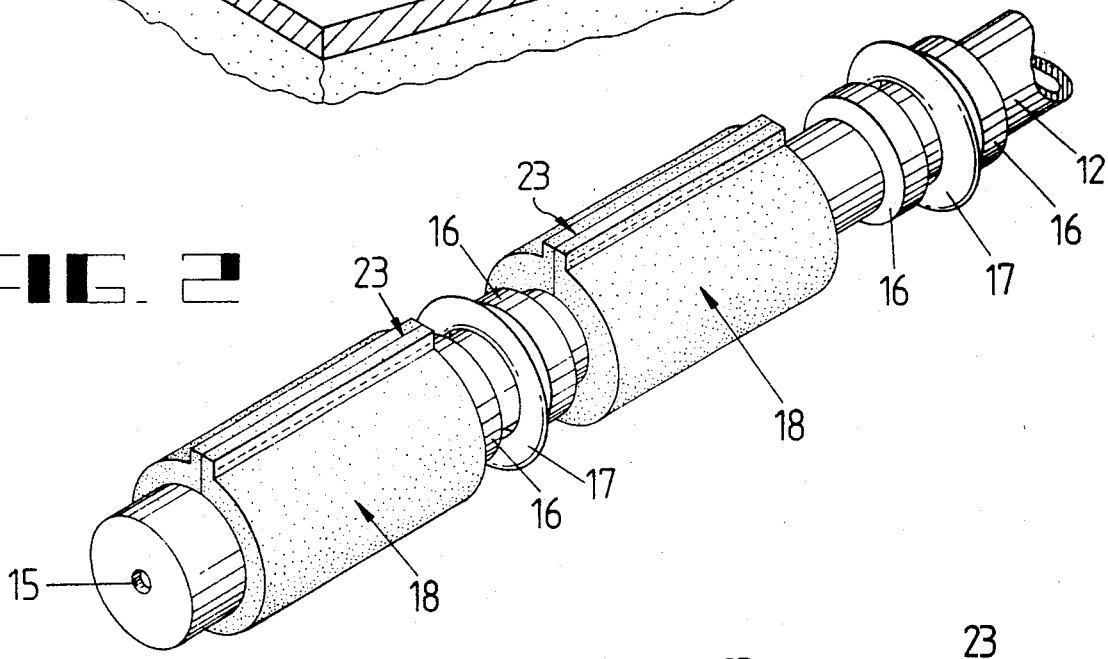
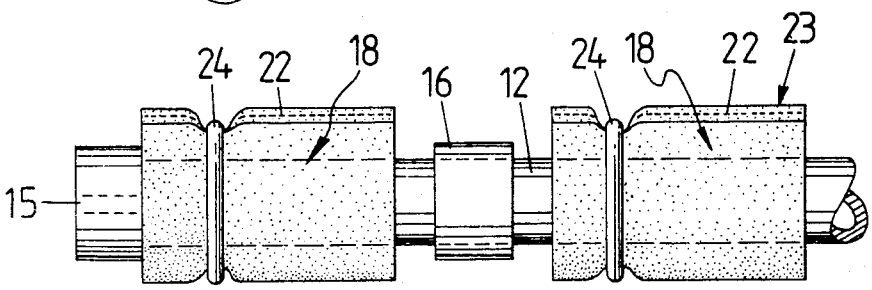
FIG. 3
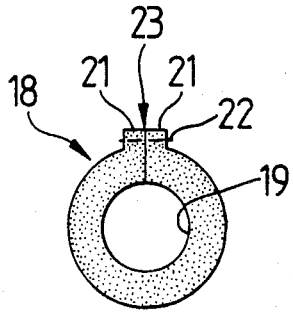
FIG. 4

BRUSH ATTACHMENT FOR AUTOMATED POOL SWEEPERS

BACKGROUND OF THE INVENTION

The present invention relates generally to swimming pool maintenance and is related directly to the use of automated pool sweepers which use one or more whip-like sweep hoses. In greater particularity the present invention may be described as a tubular brush for coaxial attachment to said sweep hoses.

Ownership of a swimming pool, although having the potential for providing pleasure and relaxation, entails a certain amount of time and effort expended to maintain the pool in its optimum condition of cleanliness. Recognizing the fact that pool owners will not enjoy the drudgery of sweeping the pool, a number of manufacturers have produced automatic residential pool cleaning systems which aid the pool owner in maintaining his pool. Included in these systems are automatic pool sweepers, such as those manufactured by Polaris or by Arneson Products, Inc. These pool sweepers, as they are understood to operate, employ a sweeper head and at least one sweep hose which has one end attached to the sweeper head and which trails along the floor and walls of the pool. Water, from an external source, is send through the sweeper head and sweep hose and is discharged from the sweep head with sufficient pressure to cause the free end of the hose to move or sweep over the floor and walls of the pool. As the hose "sweeps", the water discharged from the end thereof displaces any dirt or "dust" collected on the pool surfaces. This displacement is intended to cause the dust to settle at a lower elevation in the pool. The hoses are flexible, usually vinyl, and carry a plurality of wear-resistant rings, such as nylon rings, which are spaced axially along the hose to inhibit wear on the vinyl hose. Also, such conventional wear rings may be made with a stainless steel inner ring or an additional outer ring and are said to be useful in polishing the sides and bottom of the pool. While such systems have been found to perform their intended purposes satisfactorily, they do leave something to be desired. For example, the water pressure used to displace the "dust" is not sufficient to remove "scale" or chemical deposits which accumulate on the walls and floor. When the scale overlaps the "dust", the "dust" cannot be removed by the pool sweeper and remains in the pool as a stain. The pool floor and wall then must be scrubbed to remove the stain.

Another type pool cleaning system is an electric vacuum, such as the models by Aqua Products, Inc. The Aqua Products, Inc. device uses a self-contained filtration system mounted on an electrically driven carriage which transverses the floor and walls of a pool. Particular models include a plurality of polymer foam scrubbing brushes which are driven about a shaft concomitantly with the movement of a set of drive tracks which move the carriage. While this system provides automatic scrubbing of the walls and floor it will be appreciated that the device is from two to three times more expensive than the pool sweeper systems.

SUMMARY OF THE INVENTION

It is an object of the invention to enable a pool sweeper system to buff the pool surface while the sweep hoses are in motion thereby preventing the accumulation of scale and the overcoating of dirt by such scale.

Another object of the invention is to inhibit the growth of algae on the pool surfaces by enabling the sweep hoses to dislocate and suspend the algae in the pool.

Another object of the invention is to provide for brushing of plaster pools through the use of a pool sweeper system during the curing stage of a new plaster pool.

Yet another object of the invention is to inhibit the wear of the sweep hose and tip.

These and other objects and advantages are economically and efficiently accomplished in my invention which can transform the pool sweeper type system into a combined pool sweeping and brushing system. The wear rings of the sweep hoses hold the hoses off the bottom and sides of the pool; thus the only contact with the pool surface is at the wear rings. I utilize a tubular member made from a porous material which fits over the end portion of the hose and is held in position intermediate a pair of wear rings in contact with the pool surfaces as the hose moves over the floor and walls thereof. The tubular member is made of a foam-like material which is sufficiently light-weight that it does not retard the motion of the hose, and is porous to provide a multiplicity of scrubbing surfaces for cleaning the pool, yet is resistant to decomposition in chlorinated water and shedding due to wear.

DESCRIPTION OF THE DRAWINGS

Apparatus incorporating features of my invention are depicted in the accompanying drawings which form a portion of this application, and wherein:

FIG. 1 is a perspective view showing a floating sweeper head and a depending sweep hose with my invention attached to a portion of the hose distal the sweeper head;

FIG. 2 is an enlarged, elevational view showing the invention on a sweep hose;

FIG. 3 is a perspective view showing the invention incorporating an elastomeric retainer; and, FIG. 4 is an end view of the invention.

DESCRIPTION OF A PREFERRED EMBODIMENT

Referring to FIG. 1 it may be seen that my invention is an attachment for use with automated pool cleaning systems of the pool sweeper variety. This type pool cleaning system has a floating sweeper head 11 and at least one sweep hose 12, sometimes referred to as a whip, which depends from the head 11. A supply line 13 communicates the head with a suitable external source and provides pressurized water which is discharged from the head 11 through the sweep hose 12 thereby causing the hose 12 to sweep over the floor and walls of a swimming pool 14. The hose 12 is preferably made of vinyl and has a plurality of wear rings 16 spaced axially along a portion of its length, as shown in FIG. 1. The hose 12 terminates in a jet 15. As shown in FIG. 2 the hose may have supplemental wear rings 17.

My attachment, indicated at 18, is preferentially shaped as a tubular member having an inner surface 19 which has a diameter which is slightly smaller than the diameter of the wear rings 16. The attachment 18 is made from a foam-like material which is resistant to deterioration caused by use in chlorinated water and which is resistant to shedding due to wear from contact with the surfaces of the pool 14. While any foam-like material would appear to be suitable, such is not the case inasmuch as many such materials deteriorate rapidly when subjected to wear in a chlorinated environment such as a pool. Other foam-like materials display a tendency to shed due to wear and leave small ball-like portions of themselves on the floor of the pool 14. Such debris, left by the foam-like materials, compounds the cleaning problems. Thus, the range of materials available for optimal use in this environment may be limited. It may be noted that the polymer foam brushes used in the Aqua Products, Inc. machine may not require such attention to the type material inasmuch as that device has a self-contained filter which will remove any debris emanating from the brushes. While there may be other foam-like materials which are suitable, I have found that a PVC coated ester having 20 pores per linear inch meets the requirements for the material and is available from Scotfoam of Eddystone, Pa.

To form the tubular member, the foam-like material is cut into rectanglar sections having distinct end portions 21 and is folded over, as shown in FIG. 4. The end portions 21 are than affixed to each other to close the inner surface 19 at the appropriate diameter. The affixation of the ends 21 must be done with a material which is also impervious to loosening by chlorinated water or wear. While some glues may be suitable for the purpose, I have found that forming a seam 22 by sewing the end portions 21 together with dacron polyester thread provides a suitable affixation and yields a beneficial side effect. When the end portions 21 are sewn together in this manner a rib 23 or edge is left which can be used to stabilize the tubular member as it moves with the hose 12, thus providing more of a sliding movement across the pool surfaces. While the attachment of the hose 12 to the head 11 will limit rotation of the hose and thus restrain rotation of the attachment 18, the rib 23 will further enhance the use of the attachment. Also, the tubular member may be turned inside-out such that the rib 23 is on the inside surface. Inasmuch as the foam-like material is somewhat elastic, the rib 23 serves to further reduce the diameter and provide a better fit about the hoses between the wear rings 16.

While I have stated that one material having a pore size of 20 PPI is suitable, it is to be understood that other pore sizes may be suitable as long as they do not display a tendency to hang on irregularities of the pool surface.

In operation, one or more tubular attachments 18, which are slightly elastic, are slipped over the end of the hose 12 and are placed intermediate adjacent wear rings 16, as shown in FIGS. 1 and 2. It may be necessary to secure the attachment 18 to the hose 12 by means of a narrow elastomeric band 24, as shown in FIG. 3, which will urge a portion of the tubular member against the hose 12 and thus prevent inadvertent removal of the tubular member from the hose. It may be necessary to remove the supplemental wear rings 17 while placing the tubular members on the hose 12; however they should be replaced when the attachment 18 is properly positioned. Although several tubular attachments may be used on a single hose 12, it should be understood that flexibility of the hose 12 will be diminished to an unacceptable level if a substantial portion of the length of the hose is covered by such foam-like members.

The attachment 18 is carried by the hose 12, as shown in FIG. 1, and remains in contact with the pool surfaces as the hose sweeps over the floor and walls, thus the walls and floor are continuously buffed and brushed with sufficient force to prevent the accumulation of scale and algae. It is believed that an average pool owner will be required to replace the attachment 18 once or twice per year, assuming year-round use of his pool. Thus, this simple yet novel attachment 18 allows the pool sweeper cleaning system to provide brushing and buffing capabilities similar to the far more expensive systems mentioned earlier, yet at a minimal cost.

While I have shown my invention in but one form, it will be obvious to those skilled in the art that it is not so limited, but is susceptible of various changes and modifications without departing from the spirit thereof.

What I claim is:

1. In an automatic pool sweeper having at least one sweep hose through which water is discharged axially through a free end thereof to impart a sweeping motion to said sweep hose, with said sweep hose having a plurality of axially spaced wear members thereon, a brush attachment comprising at least one tubular section of foam-like material which is resistant to deterioration in chlorinated water, with said tubular section having an inner diameter slightly smaller than the outside diameter of said wear members and being coaxially mounted on a portion of said sweep hose intermediate adjacent wear members proximal said free end such that said tubular section moves with said sweep hose in contact with the inner surfaces of a swimming pool, with the outer surface of said tubular section having an outwardly projecting longitudinal rib thereon serving as a rotational stop to inhibit rolling motion of said section across the surface of said pool.

2. In an automatic pool sweeper having at least one sweep hose through which water is discharged axially through a free end thereof to impart a sweeping motion to said sweep hose, with said sweep hose having a plurality of axially spaced wear members thereon, a brush attachment comprising at least one tubular section of foam-like material which is resistant to deterioration in chlorinated water, with said tubular section having an inner diameter slightly smaller than the outside diameter of said wear members and being coaxially mounted on a portion of said sweep hose intermediate adjacent wear members proximal said free end such that said tubular section moves with said sweep hose in contact with the inner surfaces of a swimming pool, with said tubular section being slightly elastic whereby said section may be urged over at least one of said wear members onto said sweep hose and is resistant to inadvertent removal therefrom.

3. The brush attachment as defined in claim 2 wherein said foam-like material is a porous synthetic PVC coated ester.

4. The brush attachment as defined in claim 2 wherein said tubular section is a porous synthetic material having approximately twenty pores per inch.

5. The brush attachment as defined in claim 2 wherein said section is made of a porous non-shedding synthetic material.

6. The brush attachment as defined in claim 2 wherein said section of foam-like material has an outer surface which is sufficiently abrasive to remove scale deposits from the surfaces of a swimming pool.

7. In an automatic pool sweeper having at least one sweep hose through which water is discharged axially through a free end thereof to impart a sweeping motion to said sweep hose, with said sweep hose having a plurality of axially spaced wear members thereon, a brush attachment comprising at least one tubular section of foam-like material which is resistant to deterioration in chlorinated water, with said tubular section having an inner diameter slightly smaller than the outside diameter of said wear members and being coaxially mounted on a portion of said sweep hose intermediate adjacent wear members proximal said free end such that said tubular section moves with said sweep hose in contact with the inner surfaces of a swimming pool; and a narrow elastomeric member defining a restrictive annulus about said section and urging a portion of said section against said sweep hose to prevent inadvertent displacement of said section.

8. In an automatic pool sweeper having at least one sweep hose through which water is discharged axially to impart a sweeping motion to a free end of said sweep hose, with said sweep hose having a plurality of axially spaced wear members thereon, a brush attachment comprising at least one tubular section of porous material, which is resistant to deterioration in chlorinated water and to shedding induced by wear, with said tubular section being slightly elastic and having an inside diameter slightly smaller than the outside diameter of said wear members and being mounted coaxially on said sweep hose intermediate adjacent wear members proximal said free end such that said tubular section moves with said sweep hose in contact with the inner surfaces of a swimming pool, said tubular section having an outer surface which is sufficiently abrasive to displace scale deposits from the surfaces of said swimming pool.

9. The brush attachment as defined in claim 8 wherein said tubular section has a longitudinal rib serving as a rotational stop to inhibit rolling motion of said section across the surface of said pool.

10. The brush attachment as defined in claim 8 wherein said porous material is a synthetic PVC coated ester.

11. The brush attachment as defined in claim 8 further comprising a narrow elastomeric member defining a restrictive annulus about said section and urging a portion of said section against said sweep hose to prevent inadvertent displacement of said section.

12. A brush attachment for scrubbing the surfaces of pool walls and floors for use with automatic pool sweepers which utilize at least one sweep hose which is powered by an axial flow of water therethrough with said sweep hose having a plurality of axially spaced annular wear members thereon, comprising a tubular member of porous synthetic material having a pore size of approximately twenty pores per inch and an inner diameter slightly smaller than the outside diameter of said wear members whereby said tubular member can be mounted on said hose coaxially intermediate adjacent wear members such that said tubular member moves with said hose in contact with said surfaces; and a narrow elastomeric member defining a restrictive annulus about a portion of said tubular member and urging said portion against said hose to prevent unintentional removal of said tubular member therefrom.

13. The attachment as defined in claim 12 wherein said tubular member is made of PVC coated ester which is resistant to deterioration in chlorinated water and to shedding due to wear.

* * * * *